US009748640B2

(12) United States Patent
Nance et al.

(10) Patent No.: US 9,748,640 B2
(45) Date of Patent: Aug. 29, 2017

(54) HELIX-LOADED MEANDERED LOXODROMIC SPIRAL ANTENNA

(71) Applicant: Southwest Research Institute, San Antonio, TX (US)

(72) Inventors: Brandon L. Nance, San Antonio, TX (US); Brad D. Moore, Boerne, TX (US); James R. Noll, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 787 days.

(21) Appl. No.: 13/928,104

(22) Filed: Jun. 26, 2013

(65) Prior Publication Data

US 2016/0141747 A1 May 19, 2016

(51) Int. Cl.

| | |
|---|---|
| ***H01Q 1/36*** | (2006.01) |
| ***H01Q 9/27*** | (2006.01) |
| ***H01Q 21/20*** | (2006.01) |
| *H01Q 1/28* | (2006.01) |
| *H01Q 1/42* | (2006.01) |

(52) U.S. Cl.

CPC ..... *H01Q 1/36* (2013.01); *H01Q 9/27* (2013.01); *H01Q 21/20* (2013.01); *H01Q 1/28* (2013.01); *H01Q 1/42* (2013.01)

(58) Field of Classification Search

CPC ..... H01Q 1/362; H01Q 1/38

See application file for complete search history.

(56) References Cited

U.S. PATENT DOCUMENTS

| | | | | |
|---|---|---|---|---|
| 4,697,192 | A * | 9/1987 | Hofer | H01Q 11/083 343/708 |
| 5,854,608 | A * | 12/1998 | Leisten | H01Q 1/242 343/821 |
| 6,011,524 | A * | 1/2000 | Jervis | H01Q 1/42 343/859 |
| 6,030,667 | A * | 2/2000 | Nakagawa | H01J 37/321 118/723 I |
| 6,297,468 | B1 * | 10/2001 | Qian | H01J 37/32082 118/723 I |
| 6,400,339 | B1 * | 6/2002 | Edvardsson | H01Q 1/242 343/702 |
| 7,521,680 | B1 * | 4/2009 | Rosenthal | G01J 3/02 250/336.1 |
| 8,836,597 | B1 * | 9/2014 | Vizzio | H01Q 3/04 343/757 |
| 2003/0046042 | A1 * | 3/2003 | Butler | H01Q 1/362 703/2 |
| 2006/0001591 | A1 * | 1/2006 | Graggs | H01Q 1/288 343/895 |
| 2012/0174676 | A1 * | 7/2012 | Nyffenegger | G01V 1/186 73/647 |
| 2015/0157385 | A1 * | 6/2015 | Schwagten | A61B 18/10 606/31 |

* cited by examiner

*Primary Examiner* — Trinh Dinh

(74) *Attorney, Agent, or Firm* — Livingston Law Firm

(57) ABSTRACT

An antenna element having a metal pattern with a three-dimensional profile. The metal pattern is at least one helix-loaded helix-loaded meandered loxodromic spiral. The profile is generally that of a domed top adjoined to a rotationally symmetric body such as a conical section. Typically, the metal antenna pattern is fabricated upon or otherwise supported by a dielectric medium.

12 Claims, 8 Drawing Sheets

HELIX-LOADED MEANDERED LOXODROMIC SPIRAL ANTENNA

GOVERNMENT SUPPORT CLAUSE

This invention was made with United States Government support under Contract No. FA862011C4035 awarded by the U.S. Air Force. The Government has certain rights in this invention.

TECHNICAL FIELD OF THE INVENTION

This invention relates to radio antennas, and more particularly to a spiral antenna having a particular geometry.

BACKGROUND OF THE INVENTION

Spiral antennas are a type of radio frequency antenna, used for microwave applications. Spiral antennas belong to the class of "frequency independent" antennas; these antennas have a very large bandwidth, that is, they operate over a wide frequency range. For example, their bandwidth can be as high as 30:1, which means that if the lower frequency is 1 GHz, the antenna could still be in band at 30 GHz, and every frequency in between.

The polarization, radiation pattern and impedance of spiral antennas remain unchanged over large bandwidth. They are circularly polarized with low gain. An array of spiral antennas can be used to increase the gain. Often, the spiral is cavity-backed; a cavity of air or non-conductive material or vacuum is surrounded by conductive walls, and the cavity changes the antenna pattern to a unidirectional shape.

One shortcoming of spiral antennas is that their diameter is typically ⅓rd of a wavelength at the lowest operating frequency. This means that they cannot be arrayed close enough together at higher frequencies for adequate spatial sampling of the incoming wave.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 9 is a close-up view of the feed region of the antenna geometry of FIGS. 6-9.

DETAILED DESCRIPTION OF THE INVENTION

The following description is directed to a type of spiral antenna having a unique helix-loaded meandered loxodromic geometry. Its geometric features reduce its electrical size, especially its diameter. Multiple antennas of this design may be manufactured with a process that improves the repeatability of their received amplitude and phase response. This reduced size and repeatability make the antenna especially useful for array applications, and especially for radio direction finding applications.

As described herein, the antenna is inspired by an equiangular spiral. However, it solves the problem of the large footprint of conventional spiral antennas by conforming it to the surface of a dome, loading it with a helical section, and meandering the traces to allow the antenna to be reduced in size for the same lower frequency limit.

Antenna Structure

Figure 1:
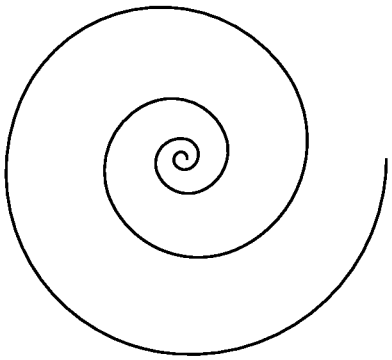
FIGS. 1-3 illustrate a loxodromic spiral on a single hemisphere, with FIG. 1 being a top view, FIG. 2 a side view, and FIG. 3 an isometric view.
Figure 2:
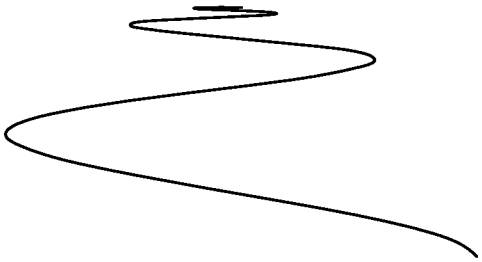
Figure 3:
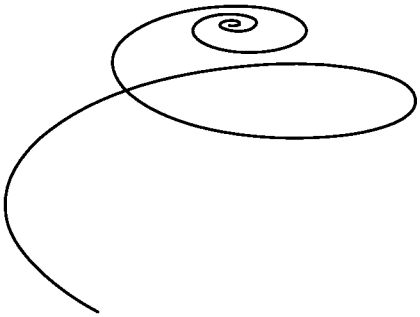

FIGS. 1-3 illustrate a loxodromic spiral on a single hemisphere. FIG. 1 is a top view, FIG. 2 is a side view, and FIG. 3 is an isometric view.

A loxodromic spiral (or rhumb line or loxodrome) is a spiral conformed to the surface of a hemisphere that cuts all lines of curvature (meridians of longitude, for example) at the same angle. A rhumb line appears as a straight line on a Mercator projection map. A loxodrome can be thought of as beginning at the equator of a globe, and passing around the globe at a constant bearing relative to true north. As long as the angle is not equal to 0 or 90 degrees, the spiral will circle around the globe getting perpetually closer to, but never reaching, one pole or the other. A loxodrome is the spherical analog of an equiangular spiral, which is used often used in antenna design.

Mathematically, a loxodromic spiral can be defined in standard spherical coordinates as a function of the angle $\Phi$, with constant radius R, and the angle $\theta$ varying as follows:

$$\theta(\phi) = \frac{\pi}{2} - \arcsin(\tanh(\beta \cdot \phi)),$$

where $\beta$ is the slope, or angle, of the curve with respect to the equator.

Figure 4:
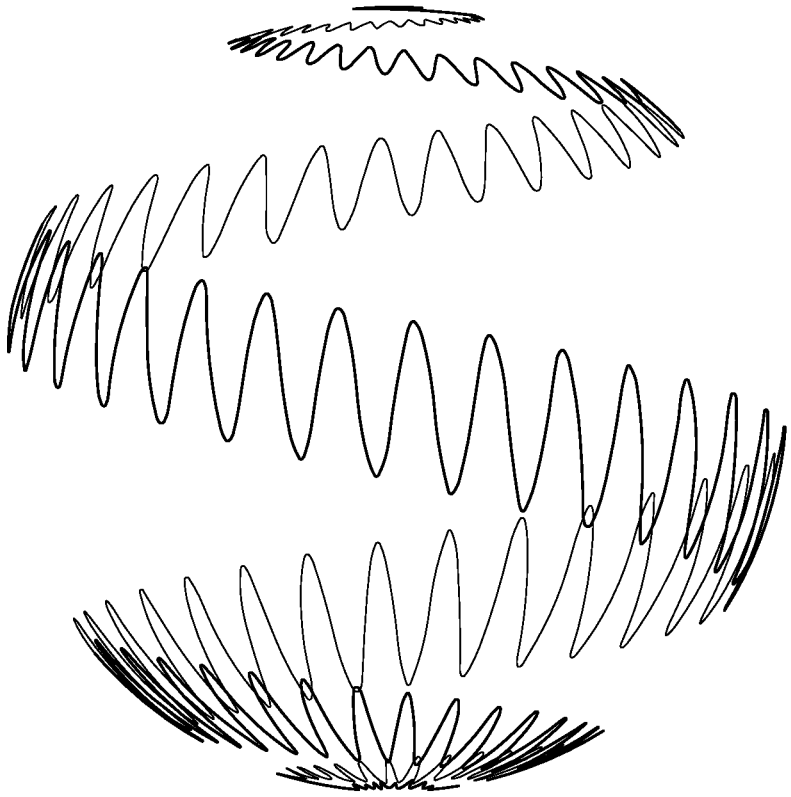
FIGS. 4 and 5 illustrate a "meandered" loxodromic spiral, with FIG. 4 being a side view and FIG. 5 an isometric view.
Figure 5:
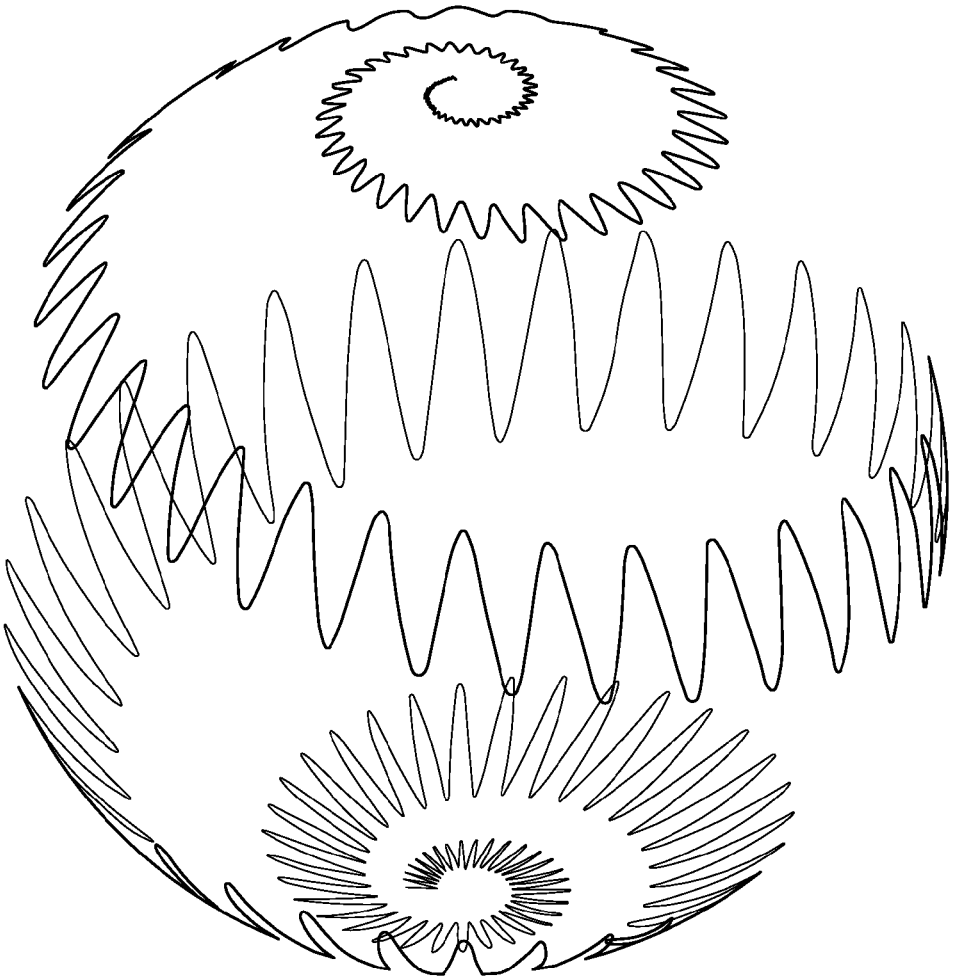

FIGS. 4 and 5 illustrate a "meandered" loxodromic spiral. FIG. 4 is a side view, and FIG. 5 is an isometric view.

If an antenna is formed by adjoining a loxodromic spiral with a helical section wrapped around a conic section, the frequency response is shifted toward lower frequencies (or the antenna can be made smaller for the same lower frequency bound). Then, by meandering the traces (in this case, a sinusoidal deviation about the loxodromic spiral path was effected), the size is further reduced. The resulting geometry is referred to herein as a "helix-loaded meandered loxodromic spiral".

As explained below in connection with FIG. 10, in the example of this description, a helix-loaded meandered loxodromic spiral antenna 100 has a diameter, D, of its conductive portion 101, measured at its base 101*b*, of 16 inches. Its lower frequency limit is 83 MHz, established by the pass band of the antenna defined such that the voltage standing wave ratio (VSWR) is <2.5. The 16-inch diameter at 83 MHz is 11.2% of a wavelength.

Referring the above mathematical description of a loxodromic spiral, the addition of a sinusoidal meander to the curve is essentially a modulation of $\theta$ as $\Phi$ is varied. The inclusion of this modulation alters the mathematical form to the following:

$$\theta(\phi) = \frac{\pi}{2} - \arcsin(\tanh(\beta\phi - \tan(\beta)M^{\arcsin(\tanh(\beta\phi))}\sin(P\phi))),$$

where β is still the slope, or angle, of the curve with respect to the equator, P is the number of cycles of the sinusoid per revolution about the polar axis, M is a constant that relates to the slope of the envelope of the modulation, which is varied by the exponent so that it decreases more rapidly near the poles. Positive values of Φ make up the upper hemisphere, while negative values denote the lower hemisphere. All these parameters may be adjusted to tailor the performance of the antenna.

With the curve of the meandered loxodromic spiral defined as above, it can be projected onto an arbitrary surface. A suitable surface, also referred to herein as the antenna "profile", is one with a hemispherical top adjoined beneath by a section of a conical surface. By creating four meandered loxodromic spiral curves on the initial sphere, each rotated 90° from its neighbor about the polar axis, and then projecting these curves onto the profile, the desired boundaries between metallized and nonmetallized surfaces are created, resulting in the final two-arm helix-loaded meandered loxodromic spiral antenna geometric form.

FIGS. 6-9 illustrate the projection described in the preceding paragraph. Specifically, they illustrate a two-arm spiral geometry of metalized surfaces bounded by meandered loxodromic spirals on a substrate surface. In other words, each "arm" 50*a* and 50*b* is made by filling the space between two adjacent helix-loaded meandered loxodromic spiral curves. Other configurations with more than two arms could also be implemented.

Figure 6:
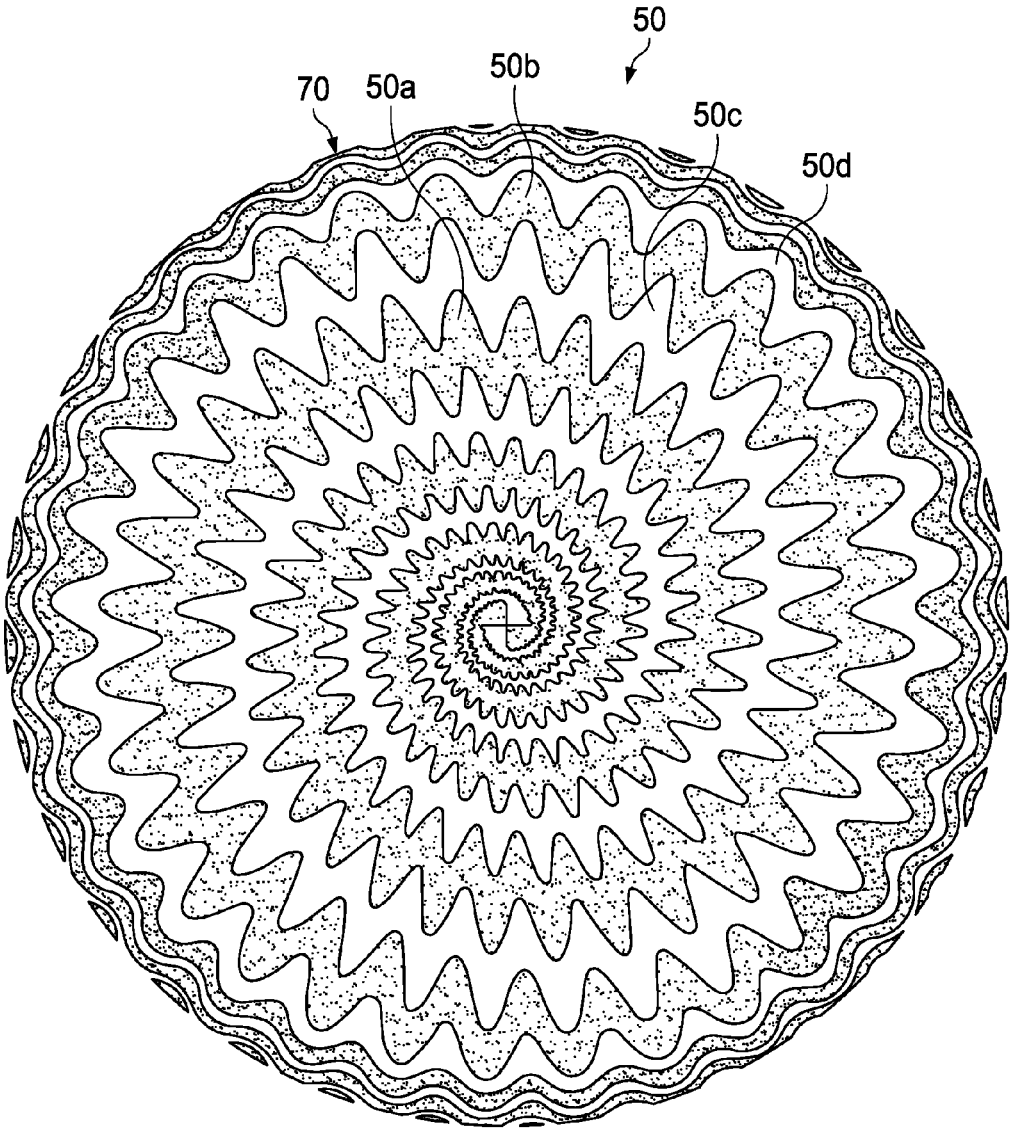
FIGS. 6-9 illustrate an antenna geometry of metalized surfaces bounded by helix-loaded meandered loxodromic spirals on a substrate surface, with FIG. 6 being a top view, FIG. 7 a side view, and FIG. 8 an isometric view.
Figure 7:
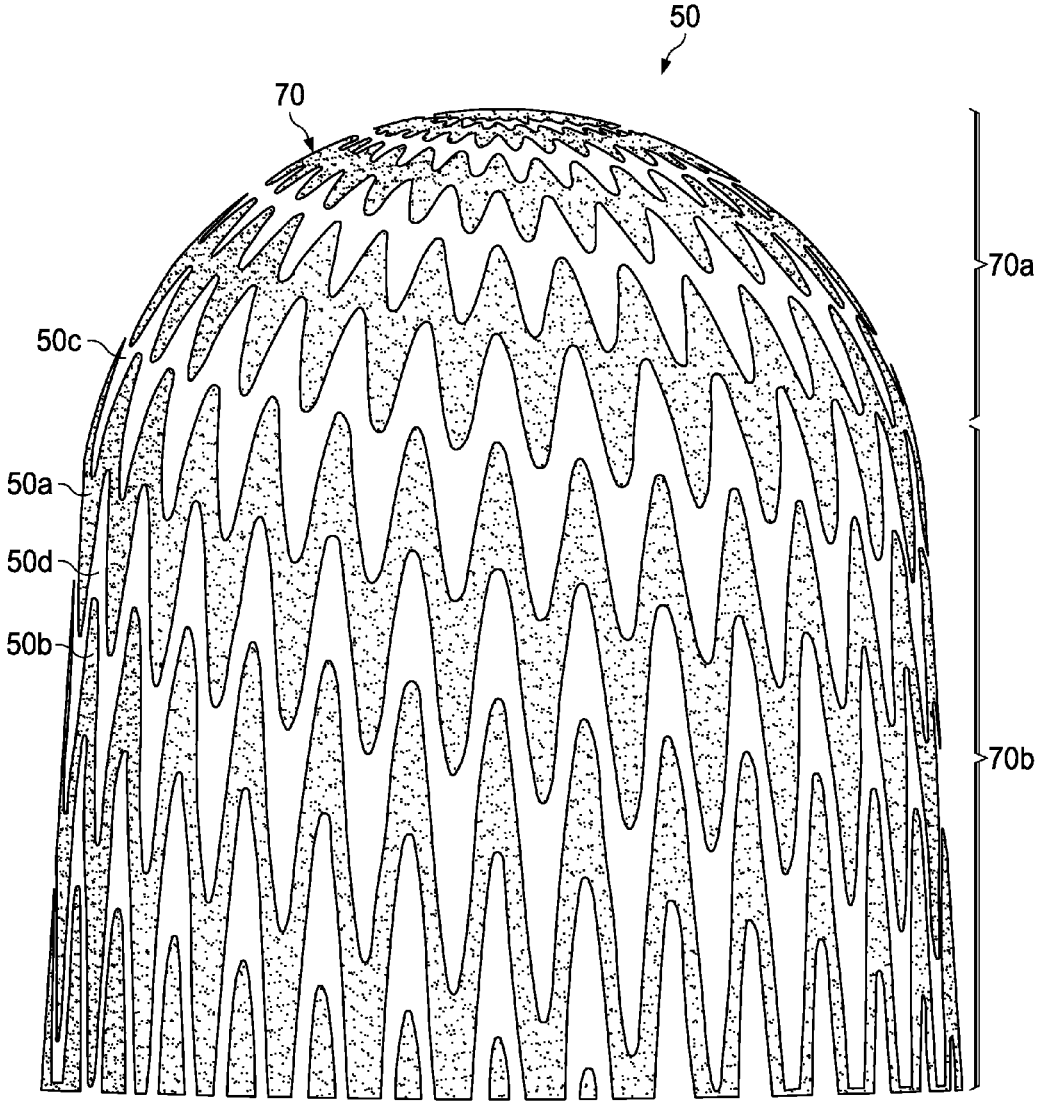
Figure 8:
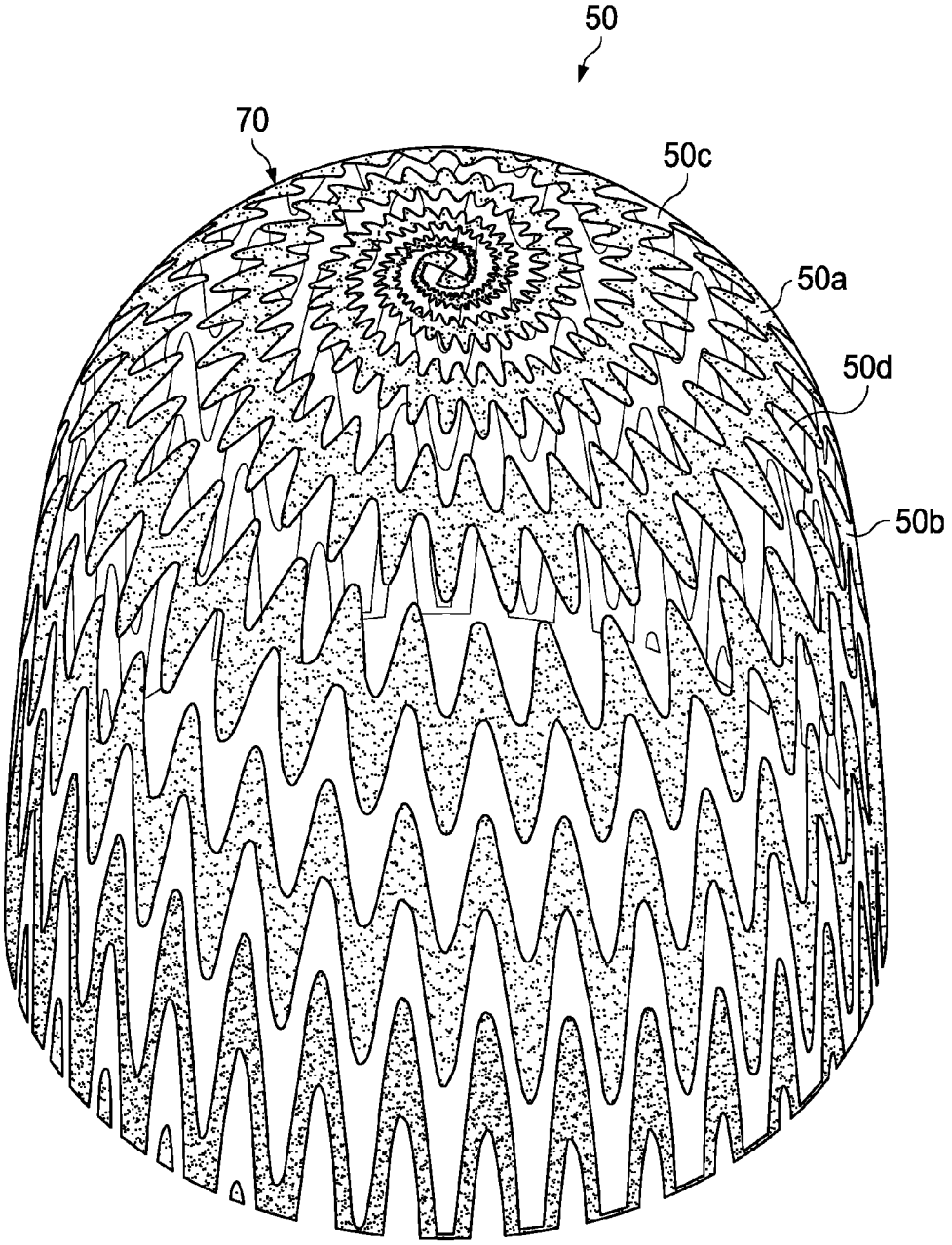
Figure 9:
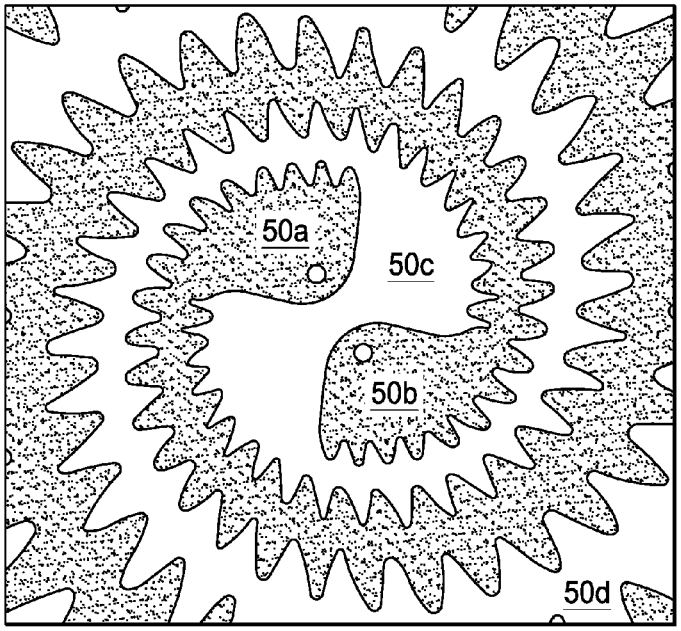

FIG. 6 is a top view, FIG. 7 is a side view, and FIG. 8 is an isometric view. As illustrated in FIG. 9, a close-up of the feed region, the spiral arms 50*a* and 50*b* are truncated near the upper pole of the hemisphere with a rotationally symmetric feed geometry.

The actual antenna 50, in particular its metal geometry, is shaded. The metal geometry is referred to herein as a "helix-loaded meandered loxodromic spiral" antenna geometry.

The metal antenna 50 of FIGS. 6-9 is typically fabricated upon, or otherwise attached to an underlying medium (see FIG. 10) having the same dome shape as the inner profile 70 of the antenna element. For antenna elements having very thin metallization, the underlying medium provides structure and support. An antenna fabricated on such a medium is described below in connection with FIG. 10. In other embodiments, it could be possible to construct an antenna 50 to be self-supporting, that is, without an underlying medium.

Regardless of whether the metal pattern of the antenna arms 50*a* and 50*b* is imposed upon a medium, the antenna element has the "profile" 70 illustrated in FIGS. 6-9. This "profile" is a hemispherical (domed) top portion 70*a* adjoined beneath by a conical body portion 70*b*.

In other embodiments, the profile of the metal pattern (or of the medium upon which the metal pattern placed) could be a hemispherical top portion 70*a* adjoined beneath by a cylindrical or parabolic body portion 70*b*. In fact, the hemispherical (domed) top portion 70*a* could be adjoined beneath by any "body" portion 70*b* having a closed shape that is rotationally symmetric.

The rotational symmetry of this entire design results in a self-complementary antenna 50. This means that the metallic arms (50*a* and 50*b*) and nonmetallic regions (50*c* and 50*d*) share the same shape and size, but they are merely rotationally offset versions of one another. If the antenna 50 is "all-metal" (self supporting), this means that the metallic arms 50*a* and 50*b* and the spaces 50*c* and 50*d* between the arms have the same shape and size. This same approach can be used to create self-complementary (or not) spirals with any conceivable number of arms.

Figure 10:
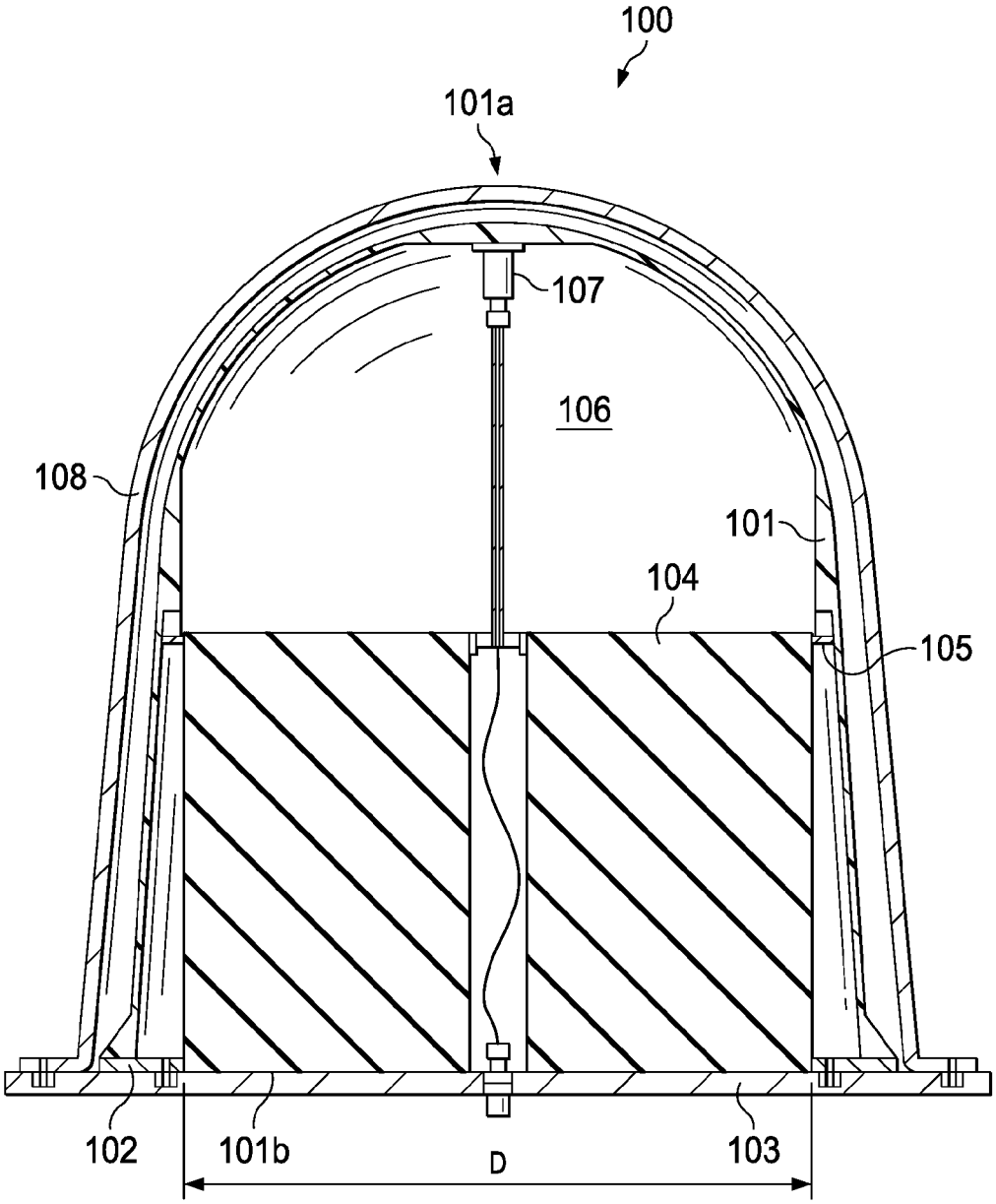
FIG. 10 is a cross sectional view of an antenna assembly having a spiral metallization antenna element with the geometry of FIGS. 6-9.

FIG. 10 is a cross sectional view of an antenna assembly 100, having a spiral metallization antenna element 101 in the configuration described in connection with FIGS. 6-9.

The antenna element 101 may be manufactured by molding or casting a dielectric material into the shape of the domed-top conical shape medium described above. The material is one that accepts metallic plating, matches metallic thermal expansion over extended temperature ranges and maintains stability over large temperature changes. An example of a suitable medium is a 30% glass-filled polycarbonate. Another example is a lexan material.

A surface map of the desired metallization may be produced using a coordinate measuring machine (CMM) and software such as Solidworks or Pro/E. The antenna pattern curves are created by intersecting surfaces derived from the meandered loxodromic spiral curves and the virtual surface matching for the produced parts.

The exterior of the medium undergoes electroless copper/nickel plating of its exterior, with masking used to avoid plating undesired locations. An example of a suitable plating thickness is 50 microns. Selective metallic plating removal is performed with a 5-axis computer numerically controlled (CNC) machine, leaving the desired geometric form of the arms of the meandered spiral and helix on the surface. The CNC machine may be programmed using an appropriate file format created by Solidworks, Pro/E, or equivalent software. The result is the domed antenna element 101, whose cross section is illustrated in FIG. 10 and whose geometric pattern is illustrated in FIGS. 6-9.

The antenna element 101 is intended to be operated over a conductive ground plane 102. The antenna element 101 has two antenna arms as discussed above, which meet at a feedpoint 101*a*. The antenna element 101 is attached to the ground plane 102 with an interconnecting baseplate 103.

Affixed to this baseplate 103, inside the antenna element 101, RF absorbing material (RAM) 104 is used to prevent unwanted interactions with the ground plane 102. This improves the radiation pattern of the antenna 100. The depth of the antenna element 101 allows for very thick absorber to be used, held in place by a retaining disk 105 or some similar mechanism. In this example, an RF absorbing layer 9 inches thick was used. Thick absorber is more effective at lower frequencies in the VHF spectrum than typical absorber (one or two inches thick) used at microwave or radar frequencies.

The air-filled cavity 106 between the RAM 104 and the feed point of the antenna 100 improves the efficiency of the antenna. This is in contrast to the conventional method of placing a planar antenna almost directly atop absorber, which introduces undesirable losses.

The balanced (antenna) to unbalanced (coaxial cable), or balun, transition can be accomplished with a transformer balun 107 that provides an impedance ratio of 4:1. This transitions the typical 50-Ω cable impedance to the antenna's impedance, here 200Ω.

For protection from the elements, the antenna element 101 may have a layer of polyurethane conformal coat applied. It may also or alternatively be covered with a rigid, transparent (at RF frequencies) cover, or radome 108.

Direction Finding Applications

The above described antenna 100, or variations having an antenna element with the above described metallization, is especially suitable for radio direction finding (DF) applications. Direction finding is a process by which a sensor estimates the direction of arrival of a propagated electromagnetic wave. This is performed with an array of antennas that typically provide a unique set of responses (amplitude and phase) for all expected angles of arrival. Such arrays typically operate over a 4:1 (frequency maximum:minimum) bandwidth or larger.

Conventionally, airborne DF arrays consist of monopole "blade" elements, which are capable of receiving only the vertically polarized component of the incident electric field, mounted upon a fixed-wing aircraft. These arrays are intended to operate at shallow depression angles (the angle subtended by the direction of arrival of the incoming wave and the horizontal plane), as monopole antennas receive virtually no power from signals arriving from directly beneath the aircraft upon which they are mounted. This is satisfactory for fixed-wing aircraft, which typically fly at a prescribed standoff distance to remain in uncontested airspace. Therefore signals of interest are not expected to arrive from beneath the aircraft.

However, when considering an airship, or dirigible, as a platform for a DF array, especially in asymmetric warfare where virtually all airspace is uncontested, the opposite is true. The aircraft are intended to virtually hover in place above a geographic area of interest that is monitored with the DF array. In these cases, monopole antennas will not suffice because signals will be arriving from beneath the aircraft, and the polarization angle of the electric field cannot be expected to be predominantly vertical.

Antenna 100 overcomes these limitations of conventional DF arrays because it is capable of receiving any linearly polarized signal over a 10:1 or greater bandwidth, with a radiation pattern that has a broad dominant lobe in one direction (away from the metallic surface it is mounted upon).

Furthermore, antenna 100 may be sufficiently small in its mounting footprint to allow other antennas in the DF array to be mounted nearby. A typical rule of thumb is less than half a wavelength at the highest frequency of interest, but with directional antennas such as these it is possible to increase this further.

With conventional algorithms, the half-wavelength is a fundamental limitation of the spatial sampling of the incoming waveform required to characterize the wave's direction of arrival. For a 4:1 bandwidth, the electrical size of the antenna (across its base) must be ⅛th of a wavelength at the lowest frequency. This is quite small for broadband operation, which by its nature requires an electrically large structure.

In general, antenna 100 may have a smaller diameter, D, than other spiral antennas. The windings are meandered and bend backward away from the feed point 101*a*, rather than remaining in the plane and spiraling outward. Also, the windings are meandered. These features contribute to its smaller size capability.

Figure 11:
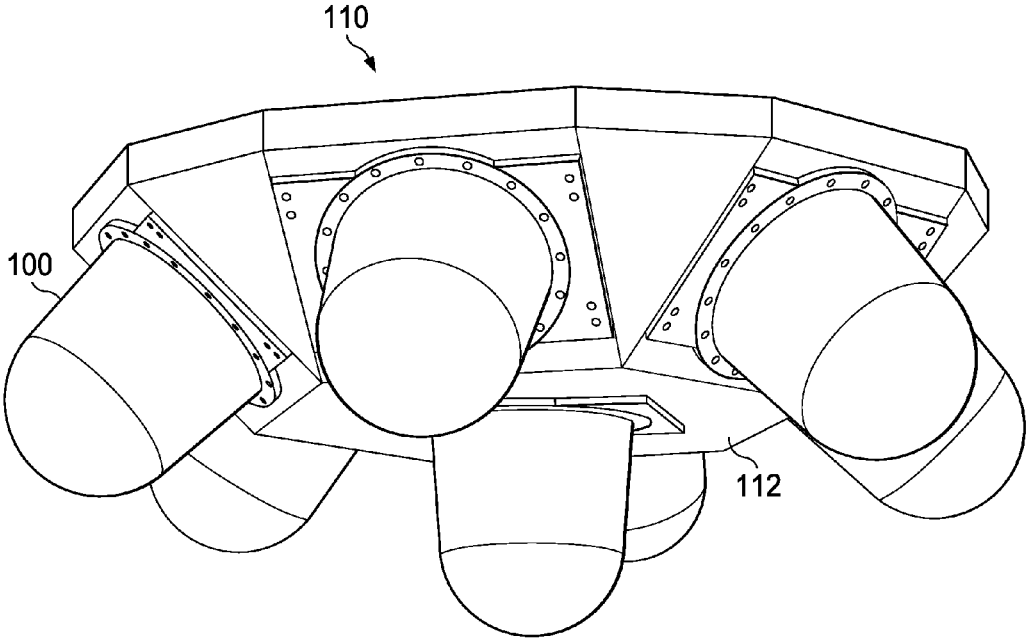
FIG. 11 illustrates an antenna array having seven antenna elements.

FIG. 11 illustrates an antenna array 110 having seven antenna elements, such as antenna 100. The antennas 100 are mounted to a lightweight faceted base 112. Array 110 is suitable for integration onto a large aircraft (airship, most likely) or a naval vessel. One of these arrays 110 could be used by itself, or two could be used independently as subarrays with the estimation of signal parameters via rotational invariance techniques (ESPRIT) algorithm (or any DF algorithm). Other array configurations can be tailored to the platform (airborne or naval), and to provide enhanced DF accuracy.

An additional problem with conventional airborne DF arrays is that there is a costly calibration process in which the antenna responses are characterized as frequency and angle of arrival (sometimes both azimuth and depression angle) are varied. This calibration process costs hundreds of thousands of dollars, and if antennas in these arrays are damaged in operation (a frequent occurrence), the DF equipment must be taken out of service and recalibrated after a new antenna is installed. The re-calibration is required because conventional antennas are not typically manufactured with tight enough tolerances, both mechanically and electrically, to produce similar enough amplitude and phase response under the same conditions. If this varies significantly from what was calibrated, excessive error is introduced in the DF performance of the DF array. A feature of antenna 100 is its high degree of "repeatability" in its manufacturing and in its responses. Its amplitude can be expected to vary less than 0.25 dB and its phase less than 5 degrees for the same test conditions.

What is claimed is:

1. An all-metal antenna for sending and receiving broadband radio frequency waves, comprising:

at least two conductive antenna arms;

wherein the antenna arms wind along and around a three-dimensional profile;

wherein the profile is generally a domed top portion atop a rotationally symmetric body portion;

wherein each antenna arm is a metallic plating following a path of a meandered loxodromic spiral on the domed top portion and a path of a meandered helix spiral on the body portion; and wherein the antenna arms have non metallic space between them and wherein the antenna arms and the space between them have the same shape and size and are rotationally offset versions of each other;

a radio frequency absorbing material that fills the bottom of the body portion to a height at least halfway up the body portion and defines an air cavity between the absorbing material and the top of the domed top portion;

wherein the body portion has a base and wherein a diameter of the base is as small as 11.2% of the wavelength of a lowest frequency of interest.

2. The antenna element of claim 1, wherein the antenna has two antenna arms offset 180 degrees about a polar axis.

3. The antenna of claim 1, wherein the body portion is a conical section.

4. The antenna of claim 1, wherein the body portion is a cylindrical or parabolic surface.

5. An antenna for sending and receiving broadband radio frequency waves, comprising:

at least two conductive antenna arms;

wherein the antenna arms wind along and around a three-dimensional profile;

wherein the profile is generally that of a domed top portion atop a rotationally symmetric body portion;

wherein each antenna arm is a metallic plating following a path of a meandered loxodromic spiral on the domed top portion and a path of a meandered helix spiral on the body portion formed by depositing metal plating between two meandered loxodromic spirals on the domed top portion and between two meandered helix spirals on the body portion;

wherein the antenna arms have non-metallic space between them and wherein the antenna arms and the space between them have the same shape and size and are rotationally offset versions of each other; and a dielectric support medium upon which the antenna is fabricated or otherwise attached;

a radio frequency absorbing material that fills the bottom of the body portion to a height at least halfway up the body portion and defines an air cavity between the absorbing material and the top of the domed top portion;

wherein the body portion has a base and wherein a diameter of the base is as small as 11.2% of the wavelength of a lowest frequency of interest.

6. The antenna of claim 5, wherein the antenna has two antenna arms offset 180 degrees about a polar axis.

7. The antenna of claim 5, wherein the support medium is made from a polycarbonate material.

8. The antenna of claim 5, wherein the body portion is a conical section.

9. The antenna of claim 5, wherein the body portion is a cylindrical or parabolic surface.

10. An antenna array, comprising:

a base;

an array of antennas mounted to the base, each antenna having at least two conductive antenna arms;

wherein for each antenna, the antenna arms wind along and around a three-dimensional profile; the profile is generally a domed top portion atop a rotationally symmetric body portion; each antenna arm is a metallic plating following a path of a meandered loxodromic spiral on the domed top portion and a path of a meandered helix spiral on the body portion; and wherein the antenna arms have nonmetallic space between them and wherein the antenna arms and the space between them have the same shape and size and are rotationally offset versions of each other; a radio frequency absorbing material that fills the bottom of the body portion to a height at least halfway up the body portion and defines an air cavity between the absorbing material and the top of the domed top portion; wherein the body portion has a base and wherein a diameter of the base is as small as 11.2% of the wavelength of a lowest frequency of interest.

11. The array of claim 10, wherein each antenna further has a dielectric support medium upon which the antenna is fabricated or otherwise attached.

12. The array of claim 10, wherein each antenna is operable to receive any linearly polarized signal with a radiation pattern that has a broad dominant lobe in one direction away from the base.

* * * * *